US005754973A

United States Patent [19]

Akune

[11] Patent Number: 5,754,973

[45] Date of Patent: May 19, 1998

[54] METHODS AND APPARATUS FOR REPLACING MISSING SIGNAL INFORMATION WITH SYNTHESIZED INFORMATION AND RECORDING MEDIUM THEREFOR

[75] Inventor: Makoto Akune, Tokyo, Japan

[73] Assignee: Sony Corporation, Tokyo, Japan

[21] Appl. No.: 452,976

[22] Filed: May 30, 1995

[30] Foreign Application Priority Data

May 31, 1994 [JP] Japan ..... 6-119333

[51] Int. Cl.[6] ..... G10L 7/02

[52] U.S. Cl. ..... 704/205; 704/219; 704/220; 704/225; 704/226; 381/731; 381/94; 381/106

[58] Field of Search ..... 395/2.1, 2.14, 395/2.15, 2.28, 2.29, 2.34, 2.35, 2.94; 381/71, 73.1, 94, 106, 107

[56] References Cited

U.S. PATENT DOCUMENTS 4,370,681 1/1983 Akagiri ..... 360/68
4,625,286 11/1986 Papamichalis et al. ..... 364/513.5
4,996,607 2/1991 Kashida et al. ..... 360/18
5,166,981 11/1992 Iwahashi et al. ..... 395/2
5,204,677 4/1993 Akagiri et al. ..... 341/118
5,563,913 10/1996 Akagiri et al. ..... 375/243

FOREIGN PATENT DOCUMENTS 3-226109 10/1991 Japan ..... H03H 17/02

OTHER PUBLICATIONS

S. Chandra et al., "Linear Prediction with a Variable Analysis Frame Size," IEEE Transactions of Acoustics, Speech and Signal Processing, vol. ASSP-25, No. 4, Aug. 1977, pp. 322-330.

*Primary Examiner*—Allen R. MacDonald
*Assistant Examiner*—Alphonso A. Collins
*Attorney, Agent, or Firm*—Limbach & Limbach L.L.P.

[57] ABSTRACT

A signal processing method is provided which detects a signal dropout portion in the input signal and which modifies the detected signal dropout portion with a signal derived from the portion in the input signal other than the signal dropout portion by predictive synthesis based upon the signal portion other than the dropout portion.

33 Claims, 11 Drawing Sheets

METHODS AND APPARATUS FOR REPLACING MISSING SIGNAL INFORMATION WITH SYNTHESIZED INFORMATION AND RECORDING MEDIUM THEREFOR

BACKGROUND OF THE INVENTION

This invention relates to a signal processing method and apparatus for processing an information dropout portion, such as clipped portion, of a continuous signal, such as an acoustic signal. The method and apparatus converts the clipped portion into a valid signal. The invention also relates to recording medium having recorded thereon a signal processed by the method and/or apparatus.

For recording audio signals, a method is currently employed in which, for achieving satisfactory recording, a recording level thought to be optimum is set at the time of rehearsal preceding live recording.

However, with the system of pre-setting an optimum recording level, if the recording level is set to a higher value, the maximum recording level is occasionally exceeded for a larger input signal level. The portion of the input signal in excess of the maximum recording level is removed by clipping.

Clipping as referred to herein means rounding signals exceeding a maximum positive value $D_{max}$ or a negative maximum value $D_{min}$ of a digital signal. Such a digital signal is produced by sampling and quantization of an input analog signal shown in FIG. 1 and which is shown in FIG. 2, to maximum values $D_{max}$ and $D_{min}$, respectively. The maximum values $D_{max}$ and $D_{min}$ are herein referred to maximum levels, respectively.

A signal reproduced from such clipped signal gives a psychoacoustically undesirable distorted sound.

SUMMARY OF THE INVENTION

In view of the foregoing, it is a principal object of the present invention to provide a signal processing method and apparatus whereby the portion of an information signal, such as speech or audio information signal, including an information dropout portion, is processed in a certain manner in order to effect psycho-acoustically desirable synthesis of the clipped portion of the information signal.

Thus it is a specific object of the present invention to provide a technique of synthesizing the signal portion clipped as a result of exceeding the maximum level. The signal portion from the results of analysis of psychoacoustic properties of a nonclipped portion of the audio signal information using, e.g., a psychoacoustic principle.

It is a further object of the present invention to create data synthesized from the clipped portion by psychoacoustic processing when recording audio data on a 16-bit word length compact disc. Using a technique in which, after synthesizing the clipped portion of the audio signal information which has previously been digitized and clipped, the quantization noise spectrum is modified for matching to so-called equi-loudness characteristics or masking characteristics for reducing the noise level as heard by the ear.

In one aspect, the present invention provides a signal processing method having the steps of detecting signal dropout portion, such as a clipped portion, in a time-domain input signal, and modifying the signal dropout portion specified by the detection step using a signal obtained based upon an input signal portion other than the signal dropout portion.

In another aspect, the present invention provides a signal processing apparatus having means for detecting signal dropout portion in a time-domain input signal, and means for modifying the signal dropout portion specified by the detection step using a signal obtained based upon an input signal portion other than the signal dropout portion.

In another aspect, the present invention provides a signal recording medium having recorded thereon a signal which is a time-domain input signal a signal dropout portion of which has been detected and modified using a signal derived from a signal portion other than the dropout portion.

The signal dropout portion is exemplified by, e.g., a clipped portion as a result of the signal exceeding the maximum recording level during recording or the maximum transmission level during transmission.

The signal dropout portion may be a signal portion clipped by the input signal exceeding the maximum recording level or the maximum transmission level during recording or transmission, respectively. The input signal may be exemplified by an audio signal.

With the signal processing method and apparatus of the present invention, at least one time-domain signal information is changed with respect to the difference in attribute. The time-domain signal information is, e.g., a time-domain audio signal. The portion of the time-domain audio signal which has exceeded a maximum recording level and clipped and the portion of the time-domain audio signal which has not been clipped are detected and the clipped portion is predicted from the unclipped portion. The prediction is performed by calculating the prediction coefficient from the frequency component which is based on the time-domain signal of the unclipped portion. The frequency spectrum is divided into critical bands for taking advantage of psychoacoustic characteristics. The allowable noise is calculated from convolution of neighboring components within the critical bands. The synthesis by prediction of the time-domain audio signals is by calculation from the prediction residue and the prediction coefficients. The prediction residue is calculated based upon the time-domain audio signal and the prediction coefficient. The prediction coefficient is calculated based upon a time-domain audio signal and a time-domain audio signal other than the clipped portion. The prediction coefficient is calculated from the allowable noise based upon the band analysis signal divided into the critical bands, the allowable noise based upon the psychoacoustic characteristics and the equi-loudness characteristics based upon the psychoacoustic characteristics. The processed time-domain signal has at least one-bit extension slot on the MSB side.

In other words, the signal processing method compares an input time-domain audio signal to a maximum level to detect whether or not the input time-domain audio signal has been clipped. On detection of a clipped portion, the signal is switched to a synthesized time-domain audio signal. If not, the signal is switched to the input time-domain audio signal. The non-clipped portion of the synthesized time-domain audio signal is orthogonal transformed to produce frequency components. The prediction coefficient is produced by e.g. predictive analysis of the frequency components. Using the prediction coefficient, the non-clipped portion of the time-domain audio signal is analyzed by linear predictive analysis to produce a prediction residue. Using the prediction residue and the prediction coefficient, a time-domain audio signal is produced by, e.g., linear predictive synthesis.

The prediction coefficient is calculated by, e.g., linear predictive analysis by synthesizing the information resulting from the band analysis, allowable noise and the equi-loudness characteristics. The allowable noise is calculated by band analysis of the frequency components and convolution. For frequency analysis and band analysis, a filter bank such as QMF or MDCT may be employed for effecting frequency spectrum splitting.

The present invention solves the above problem by analyzing the audio- signal information of the non-clipped portion by a psycho-acoustic method and by synthesizing the audio signal information of the clipped portion. The recording medium of the present invention has recorded thereon data produced on processing with the above-described signal processing method and apparatus.

According to the present invention, inconveniences due to information dropout, such as sound distortion, may be resolved by modifying the information dropout portion in the input signal by a signal derived from an other signal portion, such as by replacing the information dropout portion by a signal produced on prediction synthesis based on the other signal portion.

Specifically, the clipped portion of the speech and the audio signal may be synthesized in a manner useful for the human being by effecting psycho-acoustically supported prediction of the signal portion which has exceeded the maximum recording level and hence has been clipped from the remaining signal portion. That is, the signal portion which has exceeded the maximum level and hence has been clipped may be synthesized based upon the results of analyses of acoustic properties of the non-clipped portion of the acoustic signal information using the psychoacoustic principle.

On the other hand, when effecting recording on a compact disc having a word length of 16 bits, the clipped portion may be synthesized to produce data by synthesizing the digitized and clipped portion of the audio signal information and subsequently re-quantizing the synthesized information with noise shaping suited to the human hearing system.

On the other hand, it is effective for avoiding the processing unnecessary for sound quality not to synthesize the speech and the audio signals less than a minimum audibility limit and the allowable noise level.

DETAILED DESCRIPTION OF THE PREFERRED EMBODIMENTS

Figure 1:
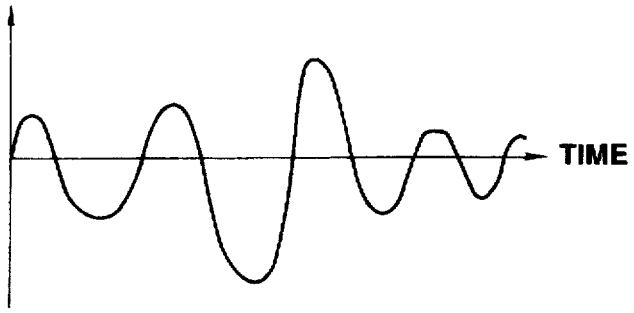
FIG. 1 is a graph showing an analog input signal for illustrating an example of clipping of the time-domain audio signal information.

Referring to the drawings, preferred embodiments of the present invention will be explained in detail.

Figure 3:
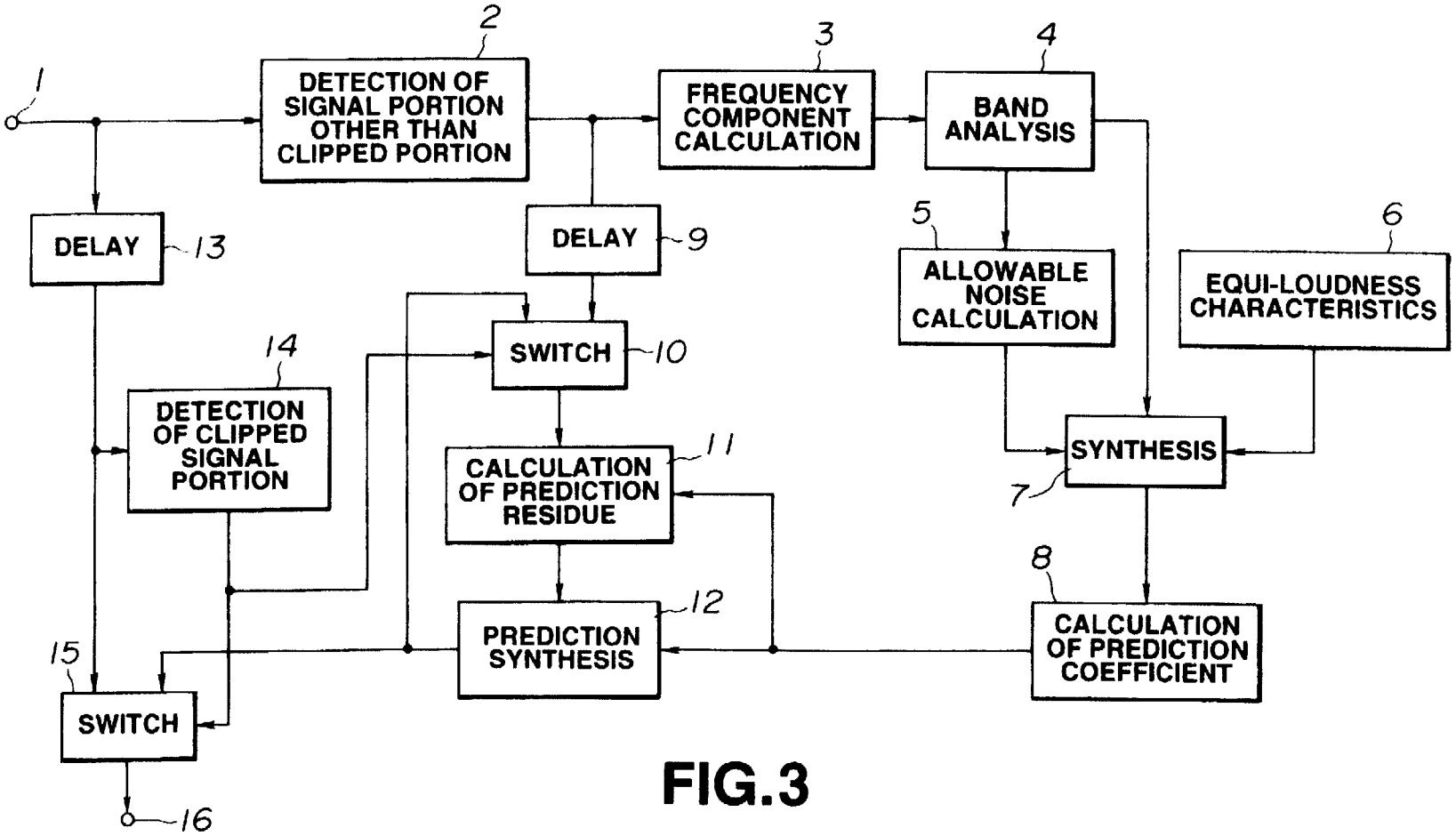
FIG. 3 is a schematic block circuit diagram showing an arrangement of a signal processing apparatus for carrying out a signal processing method of the present invention.

FIG. 3 shows, in a schematic block circuit diagram, an embodiment of an apparatus for carrying out the signal processing method according to the present invention.

With the signal processing apparatus of the embodiment shown in FIG. 1, the magnitude of an input digital signal, such as the speech signal or audio signal information (the time-domain audio signal information), supplied to an input terminal 1, is compared to a maximum level. If the input digital signal is not clipped, the audio signal information is frequency-analyzed by orthogonal transform while being divided in frequency into plural frequency bands. The band-based allowable noise information is found and the prediction coefficient is found by e.g. linear prediction analysis from the information synthesized from the equi-loudness characteristics, allowable noise information and the band analysis information. The prediction residue is obtained from the prediction coefficient and the audio signal information of the unclipped portion. The audio signal information is synthesized by linear prediction analysis from the prediction residue and the prediction coefficient.

In further detail, an input digital signal from the input terminal 1 is supplied to a circuit for detecting a signal portion other than a clipped portion 2 in which the unclipped portion of the time-domain audio signal is detected. The time-domain audio signal from the circuit for detecting a signal portion other than a clipped portion 2 is transformed by a frequency component calculating circuit 3 into frequency components which are supplied to a band analysis circuit 4 so as to be band-analyzed for each of the components in the critical bands. The allowable noise is calculated by an allowable noise calculating circuit 5 from the components obtained by the band analysis circuit 4. The component obtained by the allowable noise calculating circuit 5, the component obtained by a circuit for generating equi-loudness characteristics 6 and the component obtained by the band analysis circuit 4 are routed to a synthesis circuit 7 where they are synthesized together. A prediction coefficient calculating circuit 8 calculates a prediction coefficient from a component obtained by the synthesis circuit 7. The prediction coefficient thus produced is routed to a prediction residue calculating circuit 11 and to a synthesis circuit 12 which effects synthesis by prediction.

The time-domain audio signal from the circuit for detecting a signal portion other than a clipped portion 2 is routed via a delay circuit 9 and a switching circuit 10 to a prediction residue calculating circuit 11. The prediction residue calculating circuit 11 calculates the prediction residue from the time-domain audio signal from the switching circuit 10 and transmits the resulting prediction residue signal to a prediction synthesis circuit 12. The prediction synthesis circuit 12 synthesizes the time-domain audio signal based upon the prediction coefficient obtained from the prediction coefficient calculating circuit 8 and the prediction residue calculating circuit 11.

The input digital signal from the input terminal 1 is fed to a clipped portion detection circuit 14 via a delay circuit 13 where the clipped portion of the time-domain audio signal is detected. The detection signal from the clipped portion detection circuit 14 is routed as a switching control signal to switching circuits 10 and 15. The switching circuit 10 switches a signal from the circuit for detecting a signal portion other than a clipped portion 2 to a signal from the prediction synthesis circuit 12 or vice versa, while the switching circuit 15 switches a signal from the input signal 1 to an output signal from the prediction synthesis circuit 12 or vice versa. A signal from the switching circuit 15 is outputted at an output terminal 16. The delay circuits 13 and 9 are used for matching the timing for processing in the respective circuits and the timing of the time-domain audio signal.

The operation of the signal processing apparatus having the arrangement of FIG. 3 is now explained.

Synthesis of the clipped portion of the audio signal is by e.g. linear prediction analysis from the predictively synthesized audio signal information and the prediction coefficients. That is, the prediction residue is obtained by the prediction residue calculating circuit 11, and the audio signal is synthesized by e.g. linear prediction synthesis in the prediction synthesis circuit 12 from the prediction residue and from the prediction coefficient from the prediction coefficient calculating circuit 8. The switching circuit 15 is responsive to the result of detection of clipping of the input digital signal to output the synthesized audio signal information from the prediction synthesis circuit 12 or the input digital signal from the delay circuit 13 if the signal is clipped or is not clipped, respectively.

Figure 4:
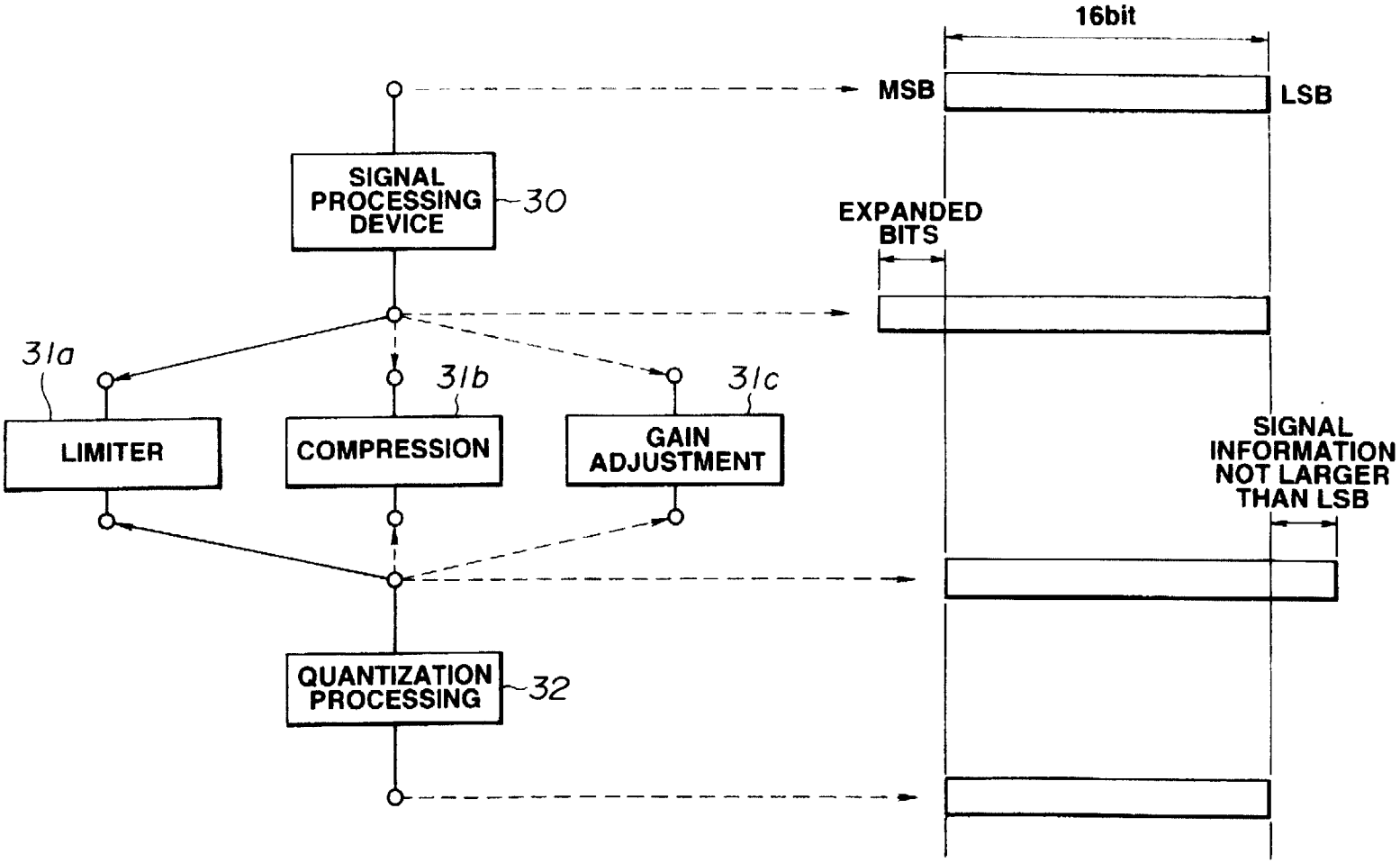
FIG. 4 illustrates an example of application of the signal processing apparatus of the present invention.

FIG. 4 illustrates changes in the bit length caused by processing by the signal processing apparatus of the present embodiment and by the subsequent processing for the case in which the input digital signal has a bit length of, e.g., 16 bits.

Figure 2:
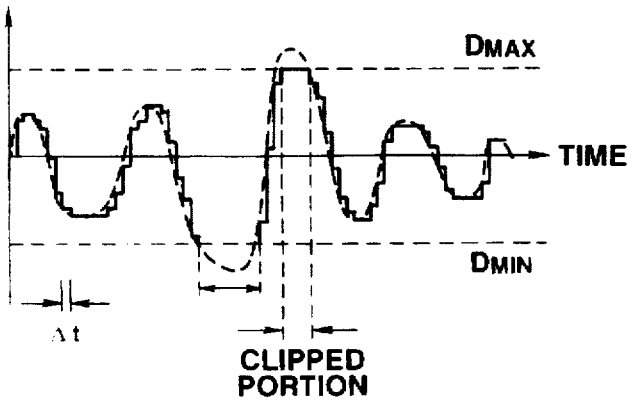
FIG. 2 is a graph showing a digital output signal for illustrating an example of clipping of the time-domain audio signal information.

In FIG. 4, if the clipped portion is processed by a signal processing apparatus 30 having an effect as shown in FIG. 2, the bit length of the output digital signal is lengthened towards a MSB side. The output digital signal is controlled so as not to exceed the maximum level by a limiter 31*a*, a compressor 31*b* or a gain adjustment unit 31*c*. The limiter 31*a* non-linearly controls the output digital signal level with respect to the input signal level so as not to exceed the maximum level, while the compressor 31*b* prohibits the sound of higher intensity from exceeding a maximum value and also prohibits the sound of smaller intensity from being masked by the ambient noise.

The digital signal, which has been protracted towards the LSB by the above processing of not exceeding the maximum level, is processed with re-quantization by a quantization unit 32 while being processed with noise-shaping in such a manner as to psychoacoustically optimize the quantization noise spectrum having a frequency range of not more than 20 kHz. An illustrative example of the processing is the so-called super-bit mapping (SBM) employed in a compact disc manufactured by SONY MUSIC ENTERTAINMENT CO. LTD. This SBM is a technique for improving audio sound quality, as disclosed by the present Applicant in the JP Patent Kokai Publication No. 3-226109 and the U.S. Pat. No. 5,204,677. For example, for re-quantizing a digital signal having a word bit exceeding 16 bits, for example, on a compact disc with a word length of 16 bits, the noise level as heard by the ear is reduced for matching to the equi-loudness characteristics or masking characteristics. This technique is employed in the psycho-acoustic processing for preparing data synthesized from the clipped portion.

The audio PCM signal having a frequency range of 0 to 22 kHz, for the sampling frequency of 44.1 kHz, is supplied to the input terminal 1 of FIG. 3. This input signal is fed to the circuit for detecting a signal portion other than a clipped portion 2. The circuit for detecting a signal portion other than a clipped portion 2 has an arrangement as shown for example in FIG. 5.

Figure 5:
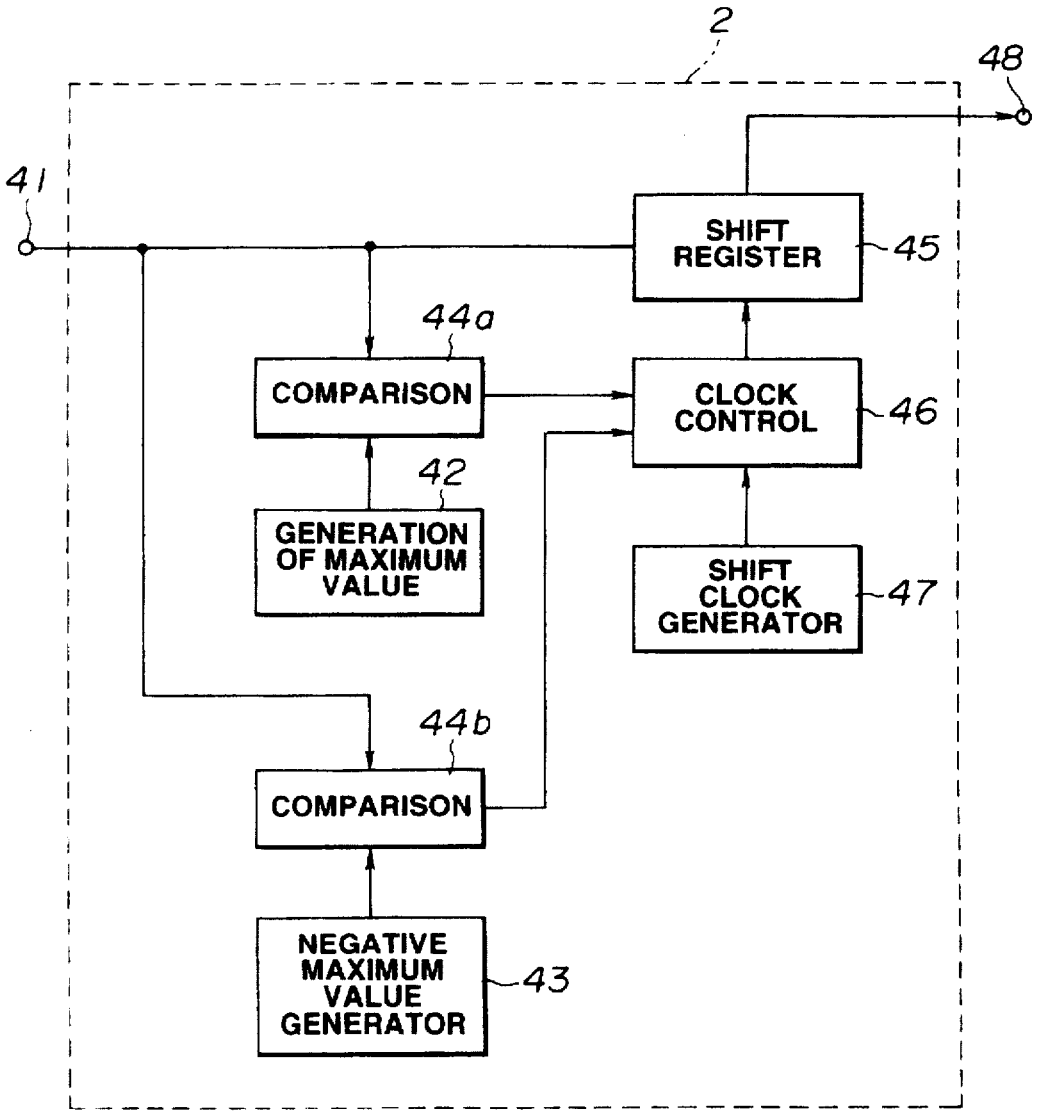
FIG. 5 is a block circuit diagram showing an illustrative arrangement of a detection circuit for detecting a signal portion other than a clipped portion.

Referring to FIG. 5, a value obtained by a maximum value generating circuit 42 is compared to an input signal at an input terminal 41 by a comparator circuit 44*a*, while a value obtained by a negative maximum value generating circuit 43 is compared to the input signal by a comparator circuit 44*b*. If the value of the input signal is equal to the maximum value or the negative maximum value, shift clocks generated by a clock generator 47 are halted by a clock controlling circuit 46. Thus a shift register 45 sequentially shifting the input signal supplied from the terminal 41 generates an unclipped signal portion not exceeding the maximum level. This signal portion is taken out via an output terminal 48.

Returning to FIG. 3, the unclipped signal portion, obtained by the circuit for detecting a signal portion other than a in clipped portion 2, is orthogonally transformed by the frequency component calculating circuit 3 to produce frequency-domain spectral data, which is then split by a frequency splitting circuit 4 into critical bands that take advantage of the psychoacoustic characteristics of the human auditory system. The signal energy for each critical band is found by calculating the sum of amplitude values of the respective frequency components in each critical band. The peak or mean values of the amplitudes may also be employed in place of the signal energy for each critical band.

Figure 6:
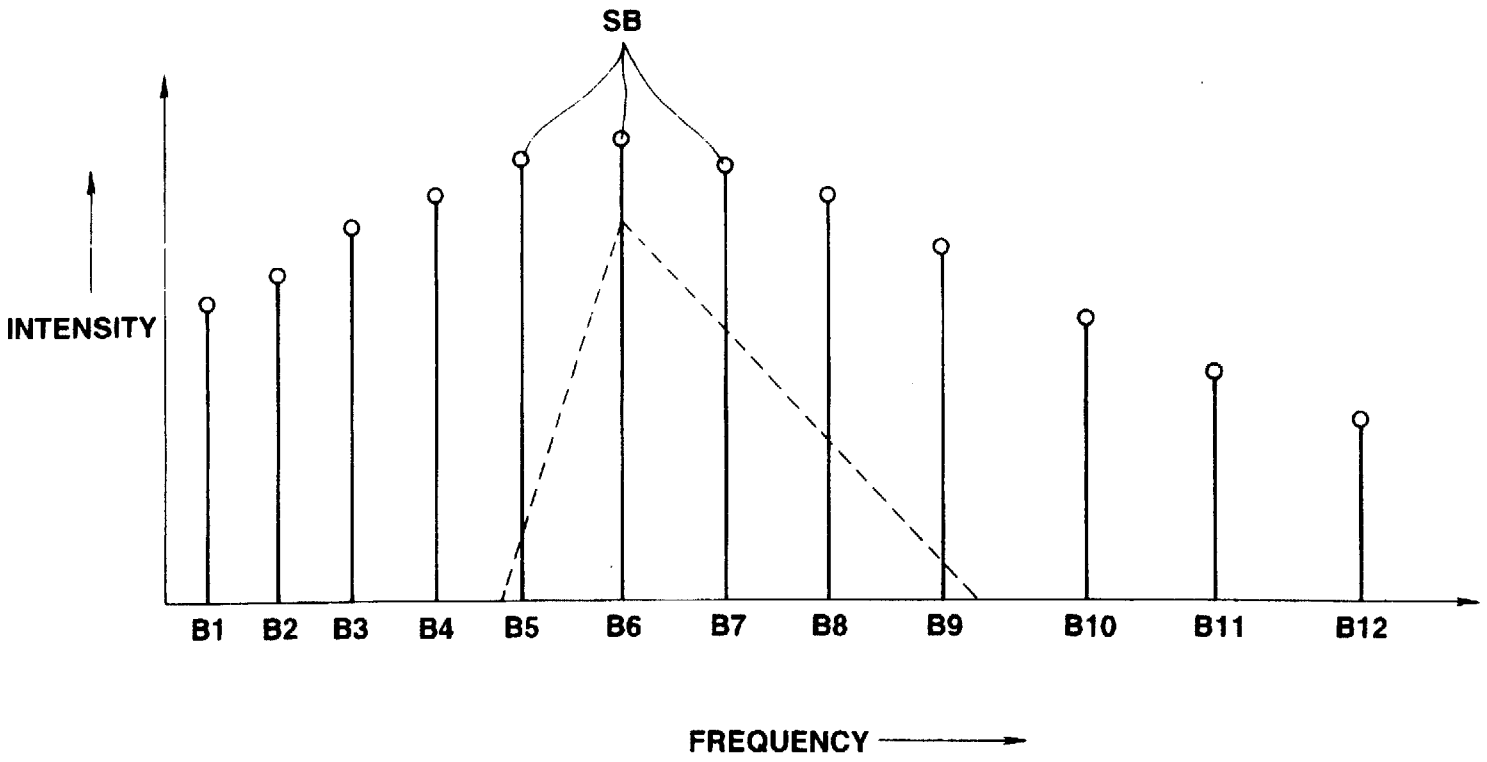
FIG. 6 is a graph showing the sum of signal components of critical bands.

FIG. 6 shows the spectrum SB which is the sum total of the spectral data for each band. In this figure, the divided bands are represented by 12 bands (B1 to B12) for simplifying the illustration.

The respective values of the spectral values SB, outputted by the band analysis circuit 4, are multiplied by pre-set weighting functions, and summed together, by way of a convolving operation, for taking into account the effect of the spectral components in the masking. To this end, the values of the spectral components, outputted by the band analysis circuit 4, are supplied to the allowable noise calculating circuit 5.

Figure 7:
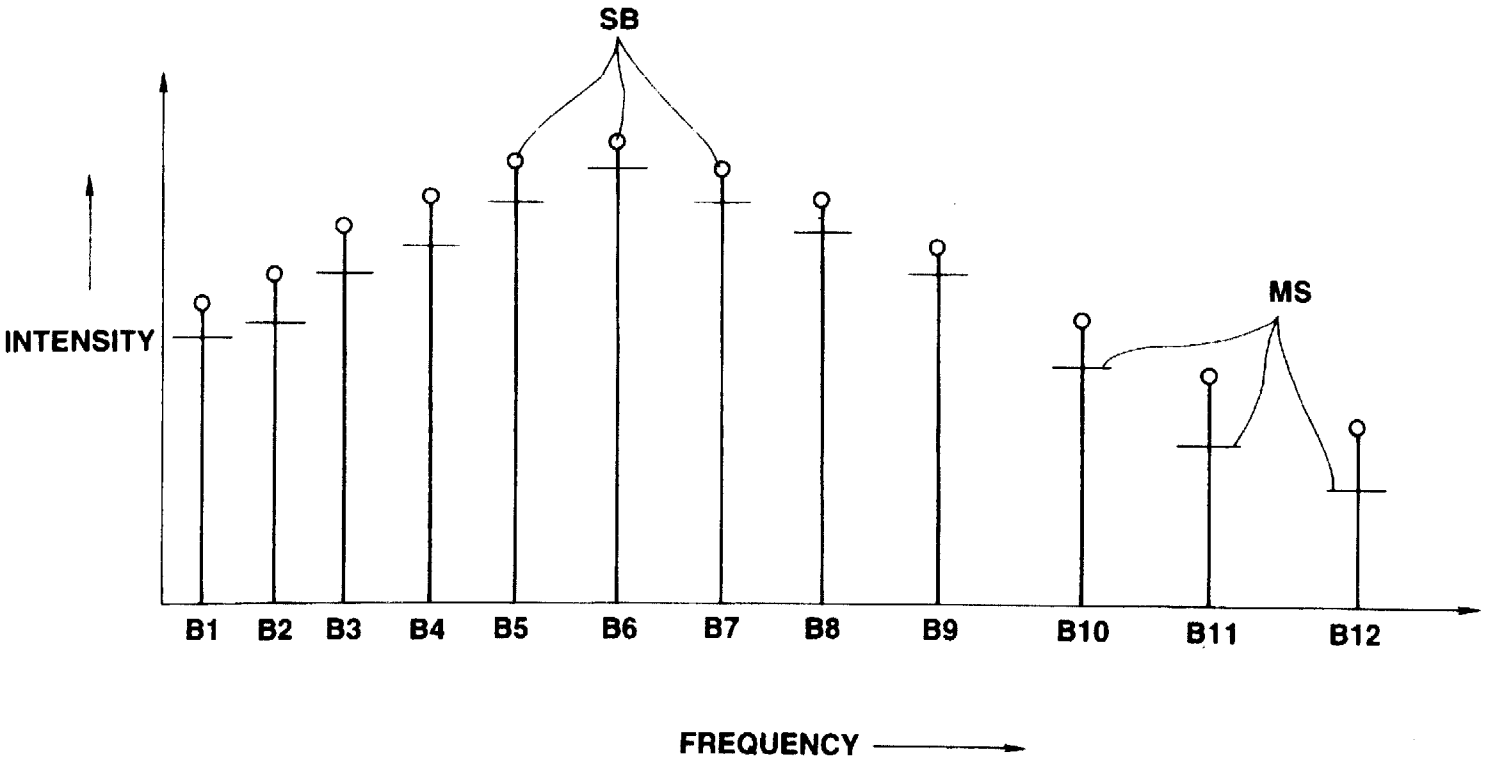
FIG. 7 is a graph showing an allowable noise and the sum of signal components of the critical bands.

The allowable noise calculating circuit 5, effectuating the convolving operation, is made up of plural delay elements for sequentially delaying input data, plural multipliers for multiplying the outputs of the delay elements with weighting functions and a sum calculating unit for calculating the sum of the multiplier outputs. By the convolving operations, the sum of an area shown by broken lines in FIG. 6 is found. FIG. 7 shows an allowable noise spectrum MS for the spectral components of the respective bands.

Masking means a phenomenon in which a signal becomes masked by another signal and becomes inaudible by psychoacoustic characteristics of the human auditory system. The masking effect is divided into chronological masking effect due to time-domain audio signals and concurrent masking effect by frequency-domain signals. By the masking effect, the signal information or the noise in the masked portion, if any, becomes inaudible. Thus, for actual audio signals, it is unnecessary to act on the signal information or the noise in the masked portion. An output of the allowable noise calculating circuit 5 is routed to the synthesis circuit 7. The synthesis circuit 7 synthesizes the signals and finds the information that can be eliminated from a processing object as later explained.

Figure 8:
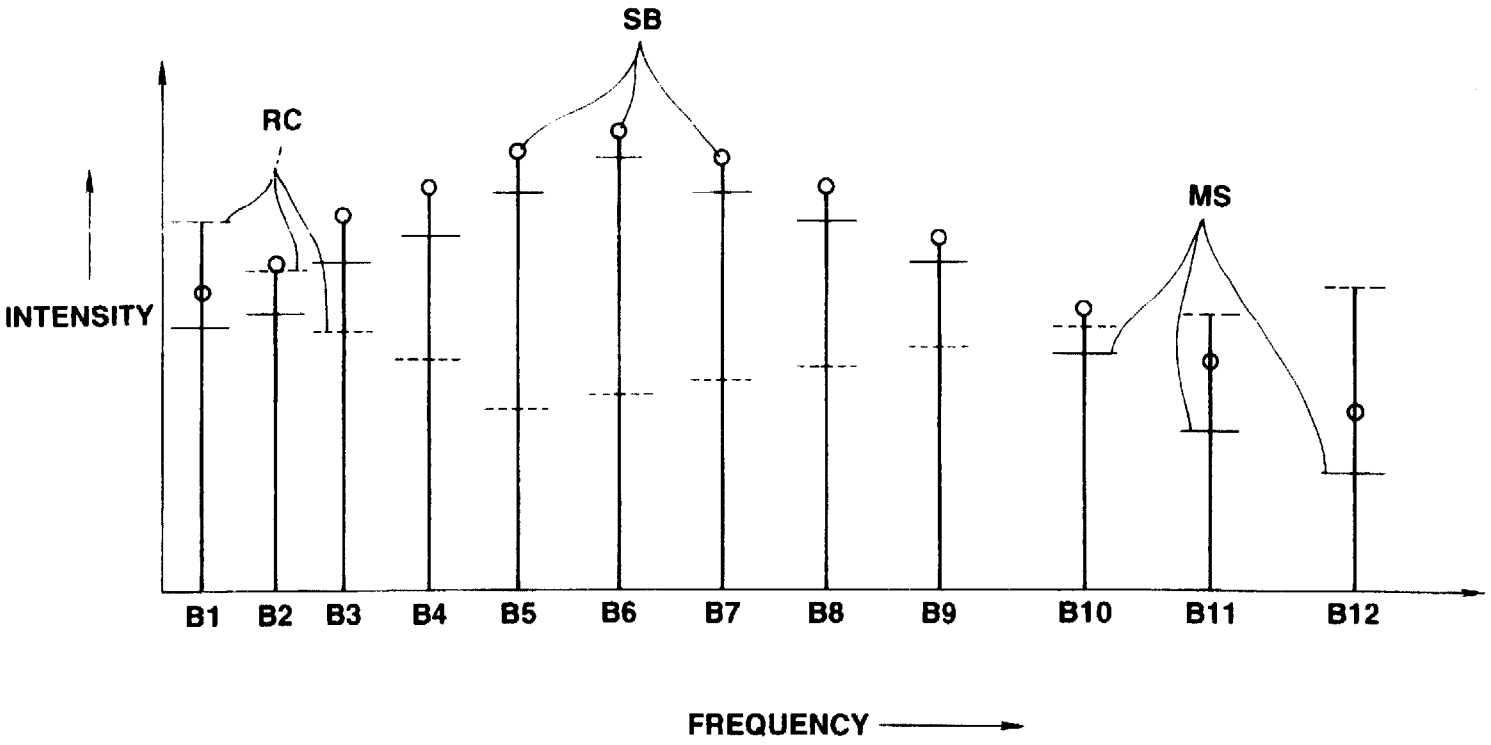
FIG. 8 is a graph showing an allowable noise and the sum of signal components of the critical bands.

The synthesis circuit 7 is fed with the spectral components SB of the respective bands, the allowable noise spectrum MS and equi-loudness characteristics RC from the circuit for generating an equi-loudness characteristic curve. Thus the synthesis circuit 7 synthesizes the allowable noise spectrum MS and the equi-loudness characteristics RC. Thus the synthesis circuit 7 synthesizes the allowable noise spectrum MS and the equi-loudness characteristics RC and the resulting spectral components are subtracted from the spectral components SB of the respective bands so that the spectral components SB of the respective bands are masked up to the level indicated by the equi-loudness characteristics RC or the allowable noise spectral components MS. The masked signal information or noise level is up to a solid line in FIG. 8.

Figure 9:
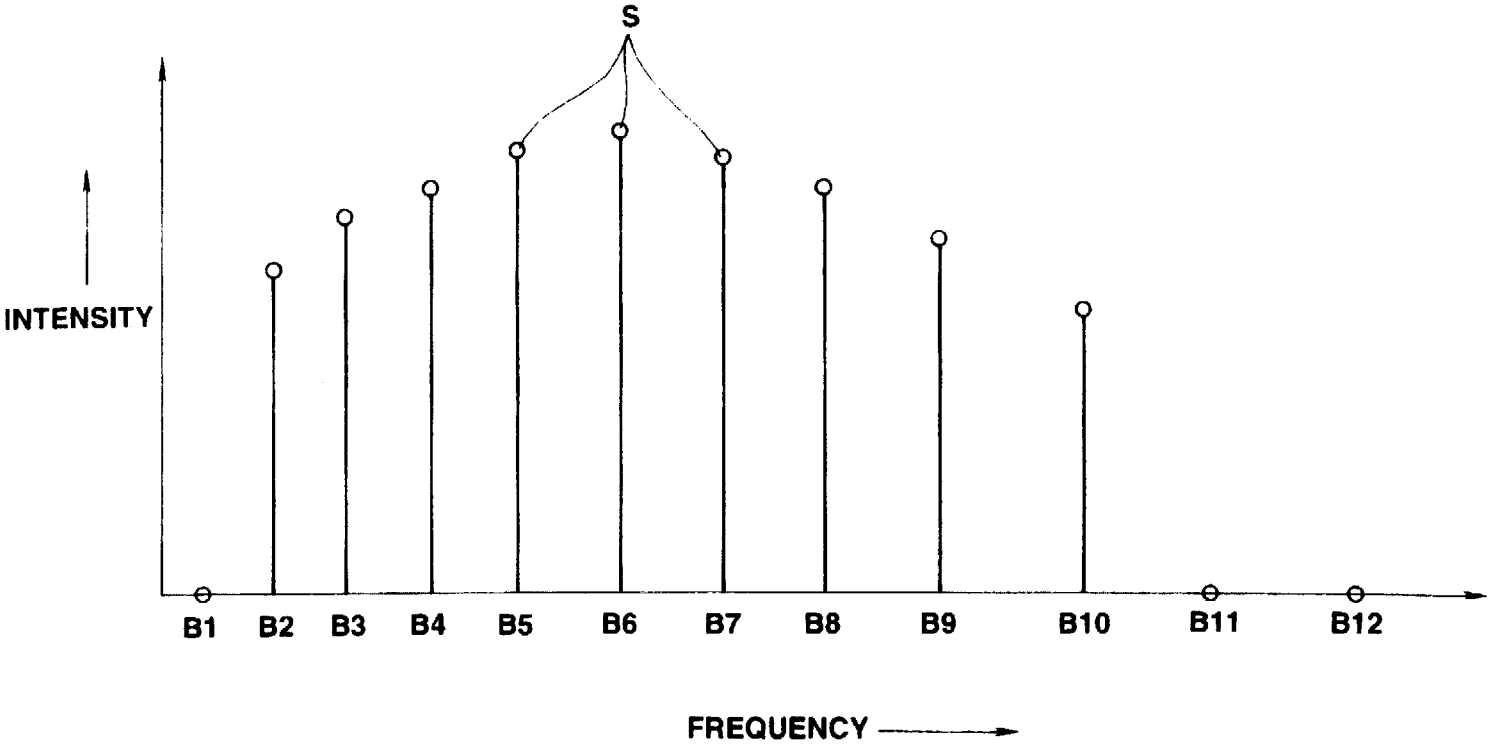
FIG. 9 is a graph showing a masking spectrum.

An output of the synthesis circuit 7 is deconvolved via a correction circuit, not shown, for correcting the signal information or noise level that can be disregarded in the processing operation, to produce a masking spectrum S shown in FIG. 9. The resulting masking spectrum S is routed to the prediction coefficient calculating circuit 8. The deconvolution, which is in need of complicated arithmetic-logical operations, is carried out in the present invention by a simplified division circuit, not shown. The masking spectrum S, which is an output of the synthesis circuit 7, is fed to the prediction coefficient calculating circuit 8.

Figure 10:
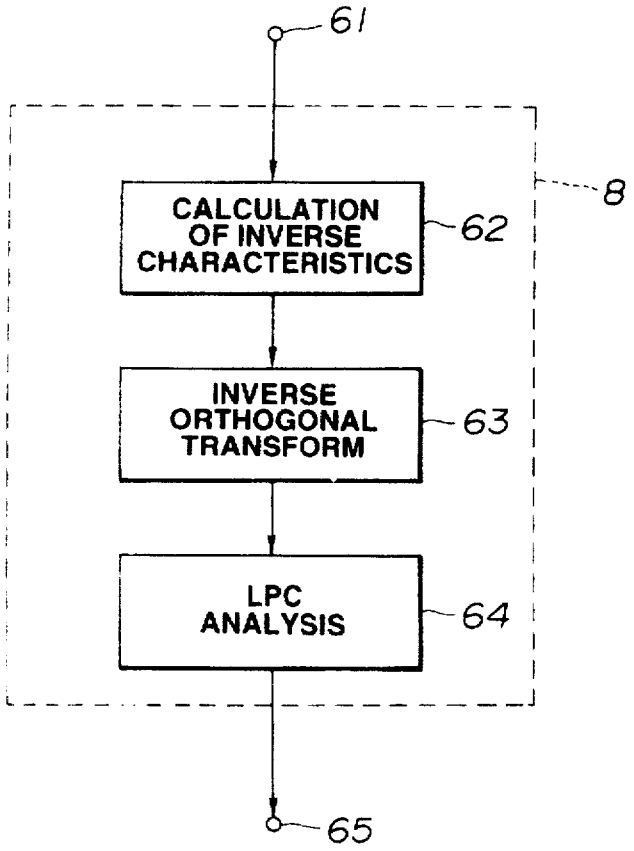
FIG. 10 is a block circuit diagram showing an illustrative arrangement of a prediction coefficient calculating circuit.

The prediction coefficient calculating circuit 8 is arranged and constructed as shown in FIG. 10.

Referring to FIG. 10, an input signal at an input terminal 61 is processed by an inverse characteristic calculating circuit 62 to produce inverse spectral characteristics from which a pseudo correlation function is obtained by an inverse orthogonal transform circuit 63. The pseudo correlation function is analyzed by an LPC analysis circuit 64 to produce a linear prediction coefficient. The inverse characteristic calculating circuit 62 finds the maximum value Smax and the minimum value Smin of the masking spectrum. The inverse masking spectrum SA is found by SA=(Sma*Smin)/S. If the inverse masking spectrum is a spectrum of the electric power, an auto-correlation function may be found by inverse FFTing the inverse masking spectrum S. This is discussed in Saito and Nakata, Fundamentals of Speech Information Processing, (c) auto-correlation function and power spectrum, Ohm Publishing Company Ltd., pp. 15, 1981.

The linear prediction coefficients are produced from the auto-correlation coefficient by an LPC analysis circuit 64 in accordance with the Durbin-Levinson-Itakura method. The Durbin-Levinson-Itakura method may also be a correlation method or the Roux method. An output of the LPC analysis circuit 64 is outputted via a terminal 65.

Figure 11:
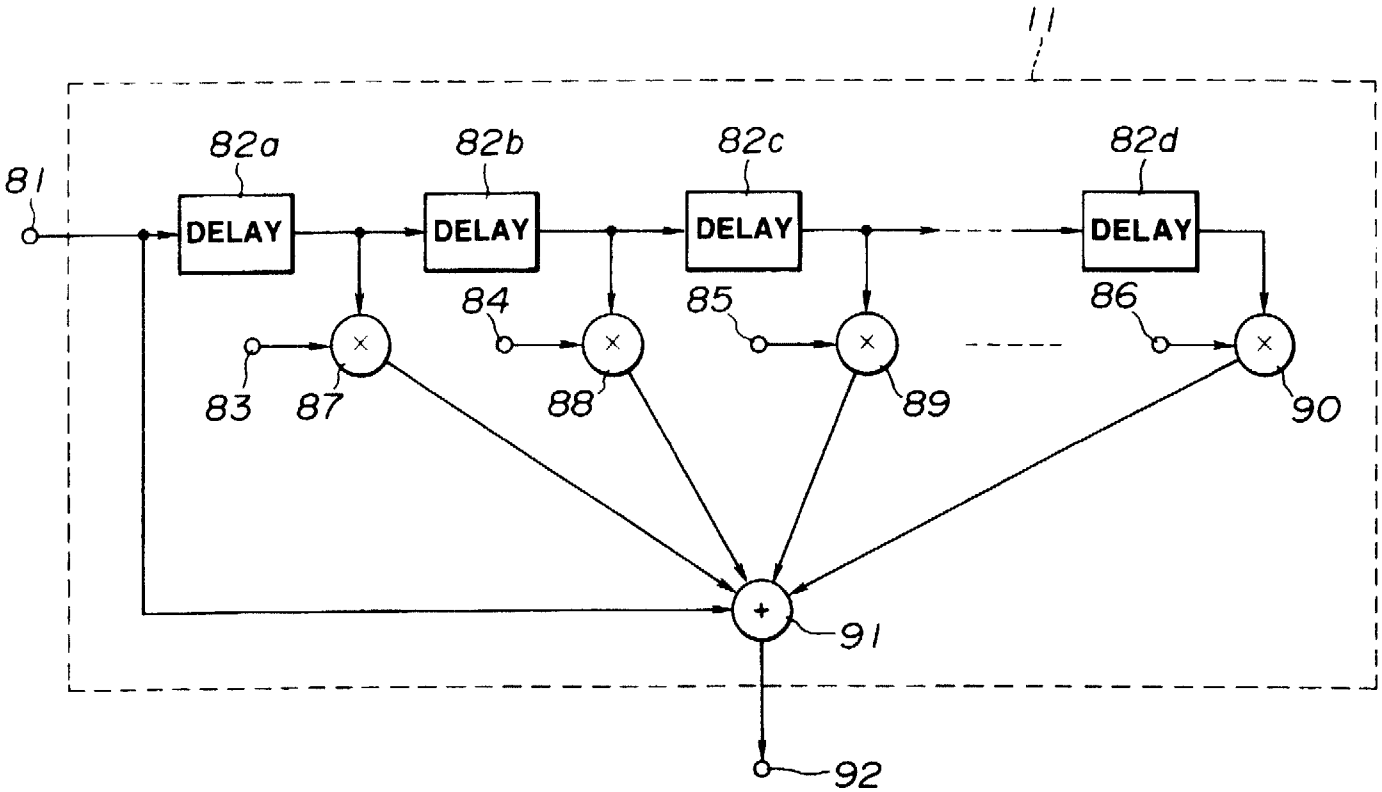
FIG. 11 is a block circuit diagram showing an illustrative arrangement of a prediction residue calculating circuit.

The linear prediction coefficient from the prediction coefficient calculating circuit 8 is supplied to the prediction residue calculating circuit 11 and to the prediction synthesis circuit 12. Referring to FIG. 11, the prediction residue calculating circuit 11 will be explained in detail.

Referring to FIG. 11, a signal supplied via a terminal 81 to the prediction residue calculating circuit 11 are sequentially supplied and shifted to a series circuit of delay elements 82*a*, 82*b*, 82*c*, . . . 82*d*. Outputs of the delay elements 82*a*, 82*b*, 82*c*, . . . 82*d* are respectively supplied to multipliers 87, 88, 89, . . . 90 where they are multiplied by linear prediction functions respectively supplied from associated coefficient input terminals 83, 84, 85, . . . 86.

Outputs of the multipliers 87, 88, 89, . . . 90 and the signal supplied to the terminal 81 are summed at an additive node 91 to produce a sum which is routed to a terminal 92. A prediction error of the output of the prediction residue calculating circuit 11 is fed to the prediction synthesis circuit 12. The prediction synthesis circuit 12 is explained in detail by referring to FIG. 12.

Figure 12:
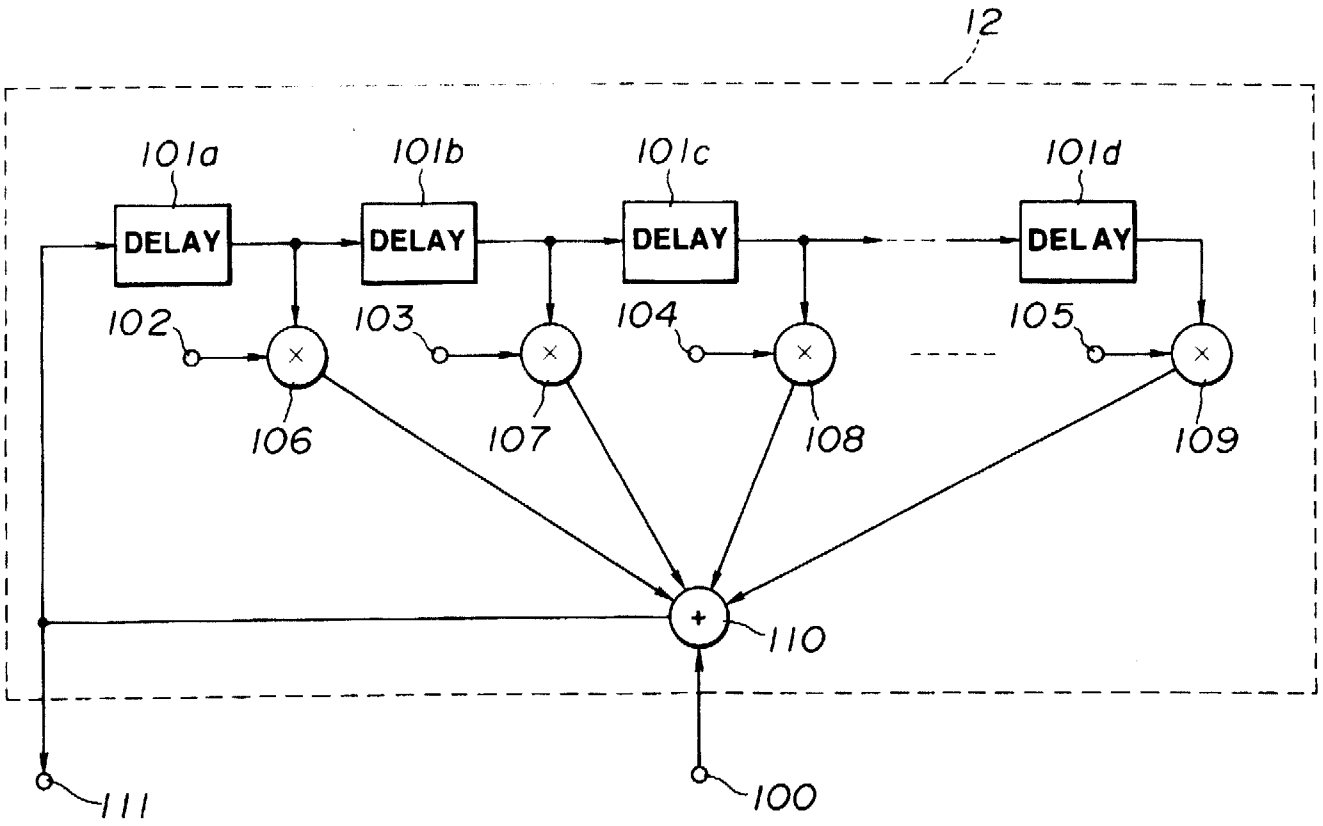
FIG. 12 is a block circuit diagram showing an illustrative arrangement of a prediction synthesis circuit.

Referring to FIG. 12, the signal routed to the prediction synthesis circuit 12 via a terminal 100 is summed at an additive node 110 to outputs of multipliers 106, 107, 108, . . . 109 as later explained to produce a sum signal which is routed to a delay element 101*a* and to a terminal 111. The signal supplied to the delay element 101*a* is sequentially shifted to a series circuit of delay elements 101*b*, 101*c*, . . . 101*d*. Outputs of the delay elements 101*a*, 101*b*, 101*c* . . . 101*d* are coupled to the multipliers 106, 107, 108, . . . 109 where the outputs of the delay elements 101*a*, 101*b*, 101*c* . . . 101*d* are multiplied with the linear prediction function supplied from associated coefficient input terminals 102, 103, 104, . . . 105. Outputs of the multipliers 106, 107, 108, . . . 109 and the signal supplied from the terminal 100 are summed at the additive unit 110.

The acoustic signal information is synthesized by the prediction synthesis circuit 12 from the prediction residue supplied from the prediction residue calculating circuit 11. The signals obtained by the prediction synthesis circuit 12 are supplied to the switching circuits 10 and 15. The clipped portion detection circuit 14 outputs "1" and "0" if the input audio signal is clipped or not clipped, respectively. The switching circuit 10 is fed with an output of the circuit for detecting a signal portion other than a clipped portion 2 passed through the delay circuit 9, an output of the prediction circuit 12 and an output of the clipped portion detection circuit 14. The output of the delay circuit 9 or the output of the prediction synthesis circuit 12 is passed through the switching circuit 10 if the output signal of the prediction synthesis circuit 12 is "0" or "1", respectively.

The switching circuit 15 is fed with a signal passed through the input terminal 1 and the delay circuit 13, an output of the prediction synthesis circuit 12 and the clipped portion detection circuit 14. The switching circuit 15 conducts an output of the delay circuit 13 or an output of the prediction synthesis circuit 12 if the output signal of the clipped portion detection circuit 12 is "0" or "1", respectively.

The output of the prediction synthesis circuit 12 or the input signal information is routed by the switching circuit 15 to the output terminal 16 if the input signal is clipped or not clipped, respectively. An output of the output terminal 16 is extended in its data length towards the MSB side by synthesis of the clipped portion. The extended data is controlled so as not to exceed the maximum level by a limiter, a compressor or gain adjustment unit. The limiter non-linearly controls the output digital signal level with respect to the input signal level so as not to exceed the maximum level, while the compressor prohibits the sound of higher intensity from exceeding a maximum value and also prohibits the sound of smaller intensity from being masked by the ambient noise. The digital signal, which has been protracted towards the LSB by the above processing of not exceeding the maximum level, is quantized such that the quantization noise spectrum in the band of not higher than 20 kHz is psycho-acoustically optimized. An output signal from the output terminal 16, processed as described above and added with error correction data, is recorded on a recording medium, such as a magneto-optical disc, a semiconductor memory, an IC memory card or an optical disc.

The present invention is not limited to the above-described embodiments and may also be applied not only to acoustic signals but to picture signals.

What is claimed is:

1. A signal processing method, comprising the steps of:

detecting signal dropout in a time-domain input signal; and modifying a signal dropout portion specified by said detection step using a signal synthesized from frequency components of an input signal portion other than the signal dropout portion.

2. The signal processing method as claimed in claim 1, wherein the signal dropout portion is a clipped signal portion, the clipped signal portion being a portion of the time-domain input signal which exceeds one of a maximum recording level during recording and a maximum transmission level during transmission.

3. The signal processing method as claimed in claim 1, wherein the time-domain input signal is an acoustic signal.

4. The signal processing method as claimed in claim 2, further comprising the step of:

detecting a non-clipped signal portion of the time-domain input signal.

5. The signal processing method as claimed in claim 3, wherein the step of modifying comprises the step of:

replacing the signal dropout portion with the signal synthesized from frequency components of the input signal portion other than the signal dropout portion.

6. The signal processing method as claimed in claim 3, wherein the signal dropout portion is predicted from the input signal portion other than the signal dropout portion.

7. The signal processing method as claimed in claim 6, wherein the prediction is calculated from frequency components of the input signal portion other than the signal dropout portion.

8. The signal processing method as claimed in claim 6, wherein the frequency components of the input signal portion other than the signal dropout portion are split at the time of the prediction into critical frequency bands based upon psycho-acoustic characteristics of a human auditory system.

9. The signal processing method as claimed in claim 8, wherein allowable noise obtained from frequency components of the input signal portion other than the signal dropout portion in the critical bands is calculated during the prediction based upon frequency components obtained from the time-domain input signal.

10. The signal processing method as claimed in claim 6, wherein the prediction is based upon calculation from a prediction residue and a prediction coefficient.

11. The signal processing method as claimed in claim 10, wherein the prediction residue is calculated based upon the acoustic signal and the prediction coefficient.

12. The signal processing method as claimed in claim 10, wherein the prediction residue is calculated based upon the prediction coefficient and the input signal portion other than the signal dropout portion.

13. The signal processing method as claimed in claim 10, wherein the prediction coefficient is calculated from allowable noise calculated from the input signal portion other than the signal dropout portion in the critical bands.

14. The signal processing method as claimed in claim 10, wherein the prediction coefficient is synthesized from an allowable noise level and equi-loudness characteristics based on psychoacoustic characteristics.

15. The signal processing method as claimed in claim 1, wherein the processed signal has at least one extension bit towards a most significant bit side.

16. A signal processing apparatus, comprising:

means for detecting signal dropout in a time-domain input signal; and means for modifying a signal dropout portion specified by said detection step using a signal synthesized from frequency components of an input signal portion other than the signal dropout portion.

17. A signal processing apparatus, comprising:

a detector for detecting signal dropout in a time-domain input signal;

a synthesis circuit for synthesizing a replacement signal from frequency components of an input signal portion other than the signal dropout portion; and a switching circuit operative to replace the signal dropout portion with the replacement signal.

18. The signal processing apparatus of claim 17, further comprising:

a first calculating circuit for calculating a prediction coefficient based upon frequency components of an input signal portion other than the signal dropout portion; and a second calculating circuit for calculating a prediction residue from the input signal portion other than the signal dropout portion and the prediction coefficient, wherein the synthesizer synthesizes the replacement signal based upon the prediction coefficient and the prediction residue.

19. The signal processing apparatus of claim 18, wherein the synthesis circuit is a first synthesis circuit further comprising:

a frequency component calculating circuit for calculating frequency components of the input signal portion other than the signal dropout portion; and a band analysis circuit for analyzing the frequency components;

an allowable noise calculating circuit for calculating an allowable level of noise based upon the frequency components;

a second synthesis circuit operative to synthesize a component based upon the frequency components, the allowable level of noise and equi-loudness characteristics of human hearing, wherein the prediction coefficient is calculated based upon the component generated by the second synthesis circuit.

20. The signal processing apparatus as claimed in claim 16, wherein the signal dropout portion is a clipped signal portion, the clipped signal portion being a portion of the time-domain input signal which exceeds one of a maximum recording level during recording and a maximum transmission level during transmission.

21. The signal processing apparatus as claimed in claim 16, wherein the time-domain input signal is an acoustic signal.

22. The signal processing apparatus as claimed in claim 20, further comprising:

means for detecting a non-clipped signal portion of the time-domain input signal.

23. The signal processing apparatus as claimed in claim 21, wherein the means for modifying comprises:

means for replacing the signal dropout portion with the signal synthesized from frequency components of the input signal portion other than the signal dropout portion.

24. The signal processing apparatus as claimed in claim 21, further comprising:

means for predicting the signal dropout portion from the input signal portion other than the signal dropout portion.

25. The signal processing apparatus as claimed in claim 24, further comprising:

means for calculating a prediction coefficient from frequency components of the input signal portion other than the signal dropout portion.

26. The signal processing apparatus as claimed in claim 24, further comprising:

means for splitting the frequency components of the input signal portion other than the signal dropout portion into critical frequency bands based upon psycho-acoustic characteristics of a human auditory system.

27. The signal processing apparatus as claimed in claim 26, further comprising:

means for calculating allowable noise obtained from frequency components of the input signal portion other than the signal dropout portion in the critical bands based upon frequency components obtained from the time-domain input signal.

28. The signal processing apparatus as claimed in claim 24, further comprising:

means for calculating a predictive residue; and means for calculating a prediction coefficient, wherein a prediction by the means for predicting is based upon calculation from a prediction residue and a prediction coefficient.

29. The signal processing apparatus as claimed in claim 28, wherein the prediction residue is calculated based upon the acoustic signal and the prediction coefficient.

30. The signal processing apparatus as claimed in claim 28, wherein the prediction residue is calculated based upon the prediction coefficient and the input signal portion other than the signal dropout portion.

31. The signal processing apparatus as claimed in claim 28, wherein the prediction coefficient is calculated from allowable noise calculated from the input signal portion other than the signal dropout portion in the critical bands.

32. The signal processing apparatus as claimed in claim 28, wherein the prediction coefficient is synthesized from an allowable noise level and equi-loudness characteristics based on psychoacoustic characteristics.

33. The signal processing apparatus as claimed in claim 16, wherein the processed signal has at least one extension bit towards a most significant bit side.

* * * * *